US010386114B2

(12) United States Patent
Fink et al.

(10) Patent No.: US 10,386,114 B2
(45) Date of Patent: Aug. 20, 2019

(54) REFRIGERATION DEVICE WITH A DRAWER

(71) Applicant: BSH HAUSGERAETE GMBH, Munich (DE)

(72) Inventors: Juergen Fink, Gerstetten (DE); Miguel Martinez De Falcon Perez, Heidenheim an der Brenz (DE); Bernd Pfister, Ulm (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/171,691

(22) Filed: Oct. 26, 2018

(65) Prior Publication Data

US 2019/0063821 A1 Feb. 28, 2019

Related U.S. Application Data

(62) Division of application No. 15/510,894, filed as application No. PCT/EP2015/070320 on Sep. 7, 2015.

(30) Foreign Application Priority Data

Sep. 29, 2014 (DE) ..... 10 2014 219 664

(51) Int. Cl.
*F25D 23/00* (2006.01)
*F25D 25/02* (2006.01)
*F25D 17/04* (2006.01)

(52) U.S. Cl.
CPC ..... *F25D 25/025* (2013.01); *F25D 17/042* (2013.01); *F25D 2300/00* (2013.01); *F25D 2317/04131* (2013.01); *F25D 2325/021* (2013.01); *F25D 2325/022* (2013.01); *F25D 2500/00* (2013.01)

(58) Field of Classification Search
CPC ..... F25D 25/025
USPC ..... 312/402, 404
See application file for complete search history.

(56) References Cited

U.S. PATENT DOCUMENTS

| | | | | |
|---|---|---|---|---|
| 9,513,049 | B2 | 12/2016 | Eisele et al. | |
| 9,546,808 | B2 | 1/2017 | Klingshirn et al. | |
| 2005/0140257 | A1* | 6/2005 | O'Halloran | F25D 23/069 312/404 |
| 2005/0156494 | A1* | 7/2005 | Bergmann | F25D 25/021 312/404 |

(Continued)

FOREIGN PATENT DOCUMENTS

| | | | |
|---|---|---|---|
| CN | 101821571 | A | 9/2010 |
| CN | 102721252 | A | 10/2012 |

(Continued)

*Primary Examiner* — Matthew W Ing

(74) *Attorney, Agent, or Firm* — Laurence A. Greenberg; Werner H. Stemer; Ralph E. Locher

(57) ABSTRACT

A refrigeration device includes a storage area which is delimited by a body and a door and which is subdivided by a shelf into an upper and a lower compartment. A drawer is accommodated in the lower compartment. In a stop position of the drawer in which it is pushed into the lower compartment, a front wall of the drawer bears against a front edge of the shelf. A closure element can be moved across a passage or opening in the shelf between a position which blocks the passage and a position which opens the passage over at least part of its cross section.

4 Claims, 5 Drawing Sheets

(56) References Cited

U.S. PATENT DOCUMENTS

| | | | | |
|---|---|---|---|---|
| 2008/0302114 | A1* | 12/2008 | Kelly | F25D 17/042 62/170 |
| 2009/0199587 | A1* | 8/2009 | Matthews | F25D 17/042 62/448 |
| 2009/0309472 | A1* | 12/2009 | Park | F25D 25/025 312/401 |
| 2011/0018414 | A1* | 1/2011 | Kim | F25D 25/025 312/402 |
| 2012/0273504 | A1* | 11/2012 | Rackley | F25D 25/025 220/592.02 |
| 2014/0300264 | A1* | 10/2014 | Park | F25D 25/025 312/404 |
| 2015/0323240 | A1* | 11/2015 | Klingshirn | F25D 17/062 62/186 |

FOREIGN PATENT DOCUMENTS

| | | | | |
|---|---|---|---|---|
| CN | 103575046 | A | 2/2014 | |
| DE | 102009029133 | A1 | 3/2011 | |
| KR | 200146134 | Y1 | 6/1999 | |
| KR | 200156044 | Y1 | 9/1999 | |
| KR | 100719252 | B1 | 5/2007 | |
| KR | 1020070109517 | A | 11/2007 | |
| WO | 2009099441 | A1 | 8/2009 | |
| WO | WO-2010029041 | A1 * | 3/2010 | F25D 17/062 |
| WO | 2013186128 | A1 | 12/2013 | |
| WO | 2015086185 | A1 | 6/2015 | |

* cited by examiner

REFRIGERATION DEVICE WITH A DRAWER

CROSS-REFERENCE TO RELATED APPLICATION

This application is a Divisional of U.S. patent application Ser. No. 15/510,894, filed Mar. 13, 2017; which was a § 371 National Stage filing of International Application PCT/EP2015/070320, filed Sep. 7, 2015, which designated the United States; this application also claims the priority, under 35 U.S.C. § 119, of German Patent Application DE 10 2014 219 664.7, filed Sep. 29, 2014; the prior applications are herewith incorporated by reference in their entirety.

BACKGROUND OF THE INVENTION

Field of the Invention

The present invention relates to a refrigeration device, in particular a household refrigeration device, which is particularly suitable for storing refrigerated goods which are susceptible to drying out. Fresh food such as fruit, vegetables, salads or fresh herbs release moisture into their surroundings until an equilibrium has been reached between them and the ambient air. Moisture that these types of food release into the air in a storage chamber of a refrigeration device generally condenses after a short time on an evaporator that cools the storage chamber, such that the humidity never reaches a saturation level. Hence the foods continuously release moisture, dry out quickly and become unsightly.

From WO 2013 186 128 AI a household refrigeration device is known, in which a cover is suspended from a shelf subdividing the storage area and which in the closed position rests on a drawer, forming a tight fit. By way of closable openings of the cover a user can adjust the strength of the exchange of air between the interior of the drawer and the surrounding storage area.

Although this design enables precise control of the exchange of air between the drawer and the surrounding storage area and in particular a good air-tight separation between drawer and storage area, it is however also to some degree complex and costly in implementation, such that it has prevailed only in refrigeration devices in the upper price range. In order also to provide a storage area with controllable humidity in low-cost refrigeration devices, a simpler, more inexpensive design is required.

SUMMARY OF THE INVENTION

It is accordingly an object of the invention to provide a refrigeration device with a drawer, which overcomes the hereinafore-mentioned disadvantages of the heretofore-known devices of this general type and which is simpler and less expensive.

With the foregoing and other objects in view there is provided, in accordance with the invention, a refrigeration device with a storage area which is delimited by a body and a door, wherein the storage area is subdivided by a shelf into an upper and a lower compartment and a drawer is accommodated in the lower compartment, in a stop position of the drawer in which it is pushed into the lower compartment a front wall of the drawer bears against a front edge of the shelf, the shelf has a passage, and a closure element can be moved between a position blocking the passage and a position opening the passage over at least part of its cross-section. Since in the stop position the front wall of the drawer bears against the front edge of the shelf or the stop position is actually defined by the abutment of the front wall on the edge of the shelf, an exchange of air between the interior of the drawer and its surroundings is ruled out in the stop position, at least along the front wall. This type of seal may be sufficient in itself, if the front wall in the stop position closes the lower compartment accommodating the drawer; if this is not the case, other solutions which are described in greater detail below are provided for preventing the exchange of air along the side walls of the drawer. Mounting the passage in the shelf renders superfluous a lid for the drawer as a component separate from the shelf.

To be easily accessible for a user, the passage is preferably arranged adjacent to the front edge of the shelf.

If in a manner known per se the shelf comprises a frame and a plate bordered by the frame, the passage is preferably recessed from the frame.

As a closure element which does not impede any other use of the drawer, a slide that moves in the plane of the passage is preferably provided.

Such a slide can be composed of two elements, one of which in each case forms a top wall and the other a lower side wall of a groove, into which the plate or a web of the frame engages, in order to guide the displacement movement of the slide between the position blocking the passage and the open position.

The frame can in particular have a web provided with openings, the openings of which form the part of the cross-section of the passage which is exposed in the open position, and which lies opposite one edge of the plate, such that the slide can be displaced between the position blocking the passages of the web and an open position, in which parts of the slide protrude onto the plate.

In order to prevent an exchange of air between the interior of the drawer by way of gaps between the shelf and the upper edges of the side walls of the drawer, attachment wall elements can be detachably mounted on side walls of the drawer.

Instead of the attachment wall elements that move with the drawer when it is pulled out, side wall elements suspended from the shelf can also be provided, which in the pushed-in stop position of the drawer seal its side walls.

Preferably the side wall elements are connected to one another via a rear wall element. The rear wall element can on the one hand serve to fix the side wall elements in respect of one another, and to ensure that in the pushed-in stop position both simultaneously seal the upper edges of the side walls; it can however also itself exhibit a sealing function between a rear wall of the drawer and the shelf.

Preferably the upper edges of the side walls of the drawer and if appropriate also the rear wall form sealing surfaces which in the pushed-in stop position bear on the suspended side and/or rear wall elements. If the side walls and where appropriate the rear wall of the drawer are braced by webs angled along their upper edges, the tops of said webs can in particular serve as sealing surfaces.

The side wall elements can be suspended from the shelf with vertical play, in order to equalize any manufacturing tolerances.

Expediently the side wall elements can then each at their upper edge have a flange facing the shelf which, by forming a narrow gap together with the shelf, cannot completely prevent the exchange of air between the interior of the drawer and the surrounding storage area, but can at least severely restrict it.

The restricted exchange of air between the interior of the drawer and its surroundings can mean that condensation forms when the humidity in the drawer is high. To make it harder for the condensate to come into contact with refrigerated goods stored in the drawer, the drawer can have an elevated floor plate, at the deepest points of which condensate can collect, while higher points lying in between protect the refrigerated goods and keep them away from the condensate. Locally deepest points of the floor plate are preferably adjacent to the walls of the drawer, firstly because such points are that much more difficult for the refrigerated goods to reach, the closer they lie to the walls, and secondly because the condensate overwhelmingly forms on the walls of the drawer.

Other features which are considered as characteristic for the invention are set forth in the appended claims.

Although the invention is illustrated and described herein as embodied in a refrigeration device with a drawer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Further features and advantages of the invention will emerge from the description of exemplary embodiments provided below, with reference to the attached figures.

DETAILED DESCRIPTION OF THE INVENTION

Figure 1:
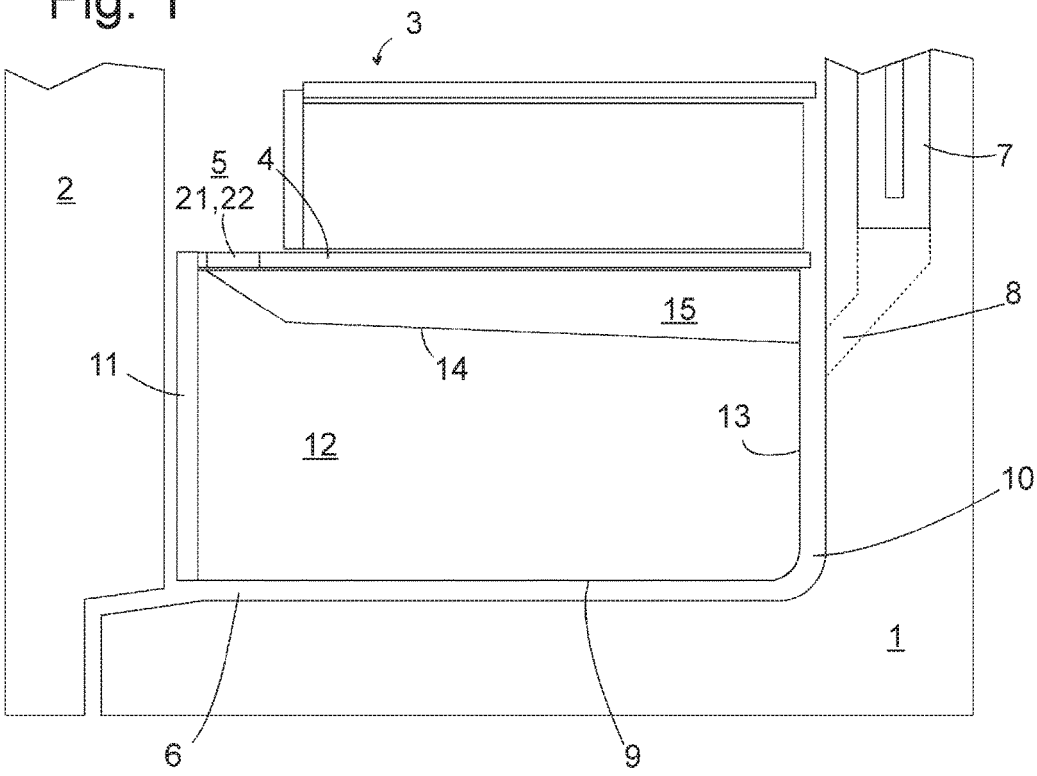
FIG. 1 shows a schematic partial section through a household refrigeration device according to a first embodiment of the invention.

Referring now to the figures of the drawings in detail and first, particularly, to FIG. 1 thereof, there is seen a schematic section through a household refrigeration device, with a body 1 and a door 2 which surround a refrigerated storage area 3. A shelf 4 subdivides the storage area 3 into an upper compartment 5 and a lower compartment 6. An evaporation chamber 7 is directly connected to the lower compartment 6 via a channel 8, such that by means of an intensive feed of cold air from the evaporation chamber 7 in the lower compartment 6 a lower temperature can be maintained than in the upper compartment 5.

A drawer 9 is accommodated in the lower compartment 6. Gaps 10 between the drawer 9 and the walls of the compartment 6 enable a free circulation of cold air around the drawer 9.

The drawer 9 has a front wall 11 which protrudes above side walls 12 and rear wall 13 and in the pushed-in stop position of the drawer 9 shown closely touches a front edge of the compartment 4. The side walls 12 have upper edges 14 sloping downward toward the rear wall 13. Attachment wall elements 15 mounted on said upper edges extend as far as immediately below the shelf 4.

Figure 2:
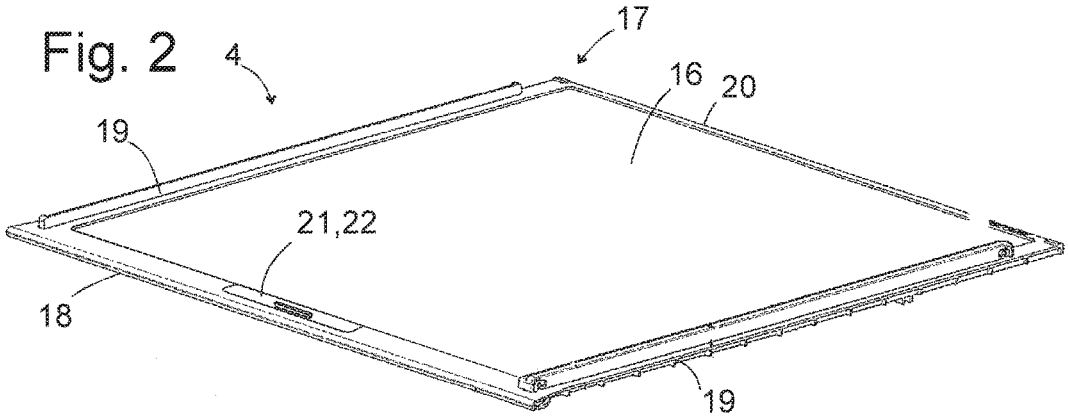
FIG. 2 shows a perspective view of a shelf used in the household refrigeration device from FIG. 1.

FIG. 2 shows the shelf 4 in a perspective view. It comprises a plate 16 made of safety glass, which is bounded by an extruded frame 17 made of plastic. A front profile 18 bordering the front edge of the plate 16 is wider than the side profile 19 and a rear profile 20 of the frame and provides space for a passage 21, which in the illustration in FIG. 2 is closed by a slide 22 that moves in the depth direction.

Figure 3:
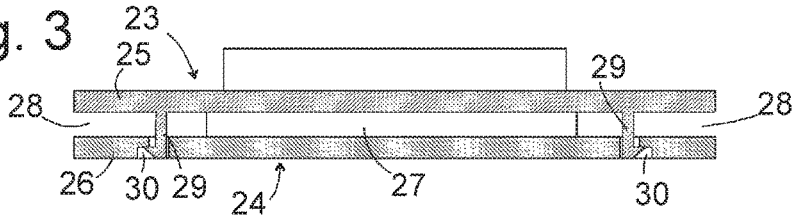
FIG. 3 shows a section through a slide used on the shelf from FIG. 2.

As can be seen in FIG. 3, the slide 22 is composed of an upper and a lower element 23, 24. Base plates 25, 26 of the elements 23, 24 are kept apart in a central region by spacers 27, such that a peripheral groove 28 is formed along their edges. The elements 23, 24 are fixed to one another by latching hooks 29 which protrude from one of the base plates 25, 26 and engage in slots 30 of the other base plate.

Figure 4:
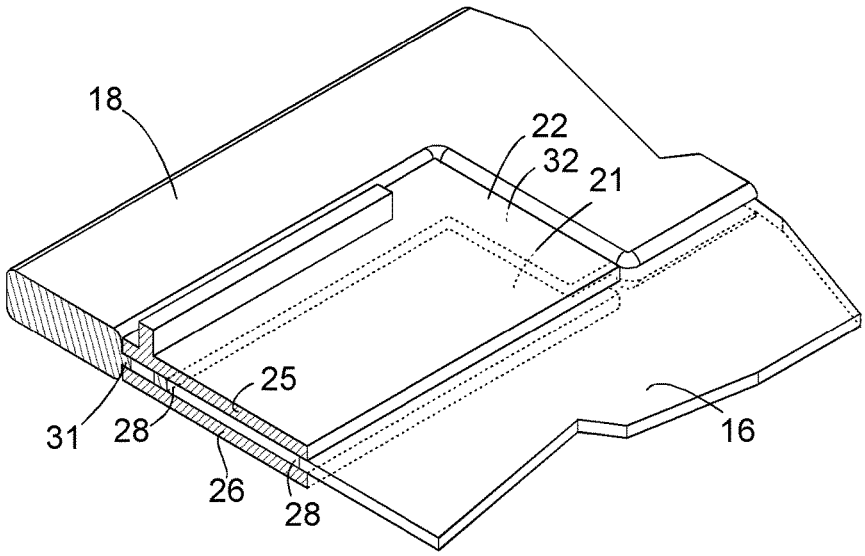
FIG. 4 shows a passage of the shelf with the slide in a position blocking the passage, partially in perspective view and partially in section.
Figure 5:
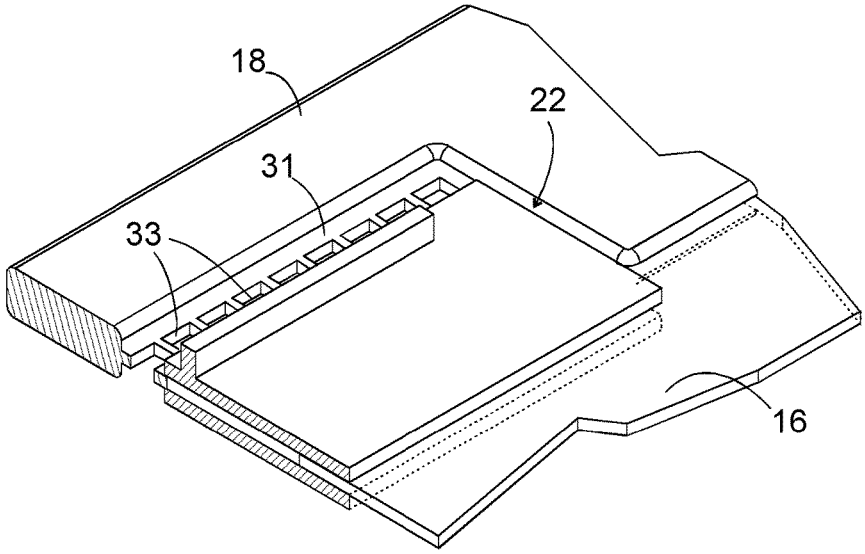
FIG. 5 shows a view analogous to FIG. 4 which shows the slide in a position opening the passage.

FIG. 4 shows the slide 22 in the position closing the passage 21 partly in a perspective view, and partly in section. A web 31 of the front frame profile 18 and the front edge of the plate 16 engage on respectively opposing sides into the groove 28 of the slide 22. The plate 16 does not extend as far as a base of the groove 28, such that the slide 22, guided by a web 32 of the profile 18 which is shown by a dashed line in FIG. 4 and which engages on a narrow side of the slide 22 into the groove 28, can be moved from the position in FIG. 4 into a position shown in FIG. 5, in which the web 31 is largely exposed and an exchange of air is possible via openings 33 of the web 31 between the upper compartment 5 and the interior of the drawer 9 arranged above the shelf and hence moisture can escape from the drawer 9. The magnitude of the exchange of air can be controlled by a user, by selecting a position of the slide 22 between the two extreme positions in FIGS. 4 and 5, in which the openings 33 are more or less extensively concealed.

Figure 6:
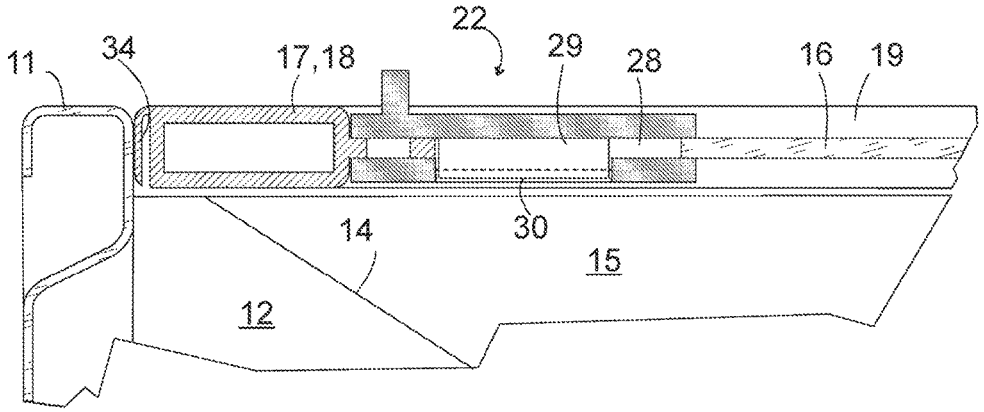
FIG. 6 shows a schematic section through the front edge region of the shelf and the drawer in a pushed-in stop position, in which the front wall of the drawer touches the front edge of the shelf.

In order to minimize an exchange of air between the interior of the drawer 9 and its surroundings that cannot be controlled by the user, a seal is provided between the front edge of the shelf 4 and the front wall 11 of the drawer 9. As shown in FIG. 6, this seal can be designed as a flexible lip 34 on the front edge of the shelf 4, which is pressed into contact with the rear side of the front wall 11; alternatively such a seal could also be attached to the rear side of the front wall 11.

Figure 7:
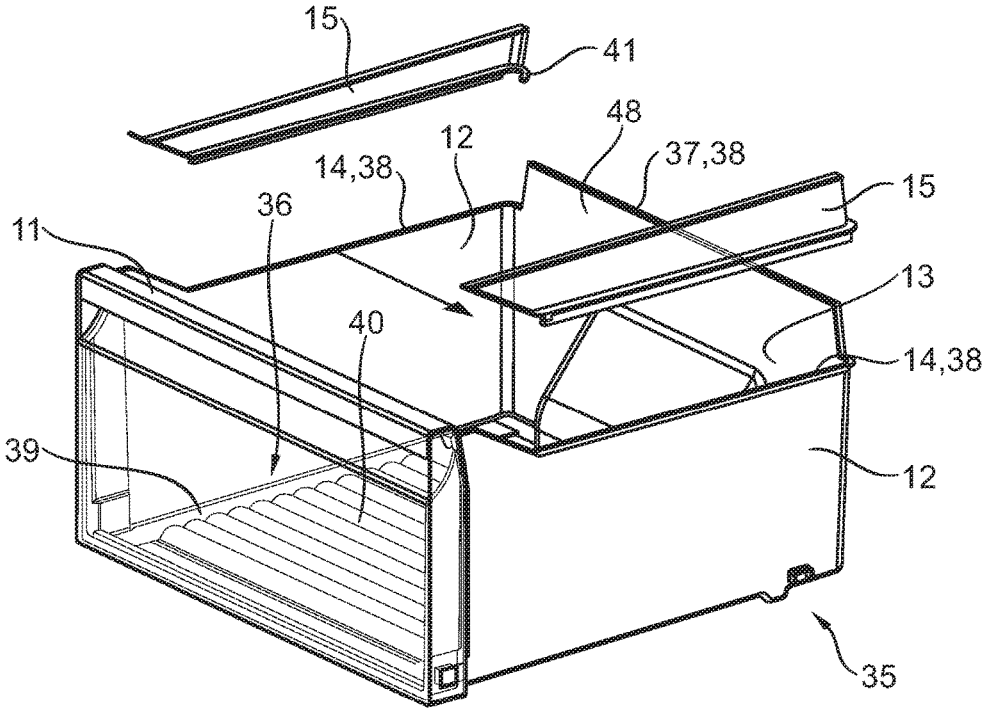
FIG. 7 shows an exploded perspective view of the drawer.

FIG. 7 shows the structure of the drawer 9 in greater detail in an exploded perspective view. A base part 35 formed integrally from plastic forms the base plate 36, the side walls 12 and the rear wall 13 of the drawer 9. Along their upper edges 14, 37 the walls 12, 13 are reinforced by webs 38 projecting outward.

The front wall 11 manufactured from transparent plastic is latched onto the base part 35. The base plate 36 which is partially visable through the front wall 11 has an elevation in the form of a ribbed central plateau 40 surrounded by a trench 39 extending as far as the base of the walls 11, 12, 13. Condensate that precipitates on the walls can collect in the trench 39, such that refrigerated goods lying on the ribs of the central plateau are protected against the penetration of moisture.

The side walls 12 attain their greatest height directly at their front end; along a large part of their length they run a few centimeters deeper, at a considerable distance from the shelf 4, such that they prevent an intensive exchange of air between the drawer 9 and its surroundings. If refrigerated goods which are susceptible to drying out are to be accommodated in the drawer 9, it is expedient to close these passages with the help of the attachment wall elements 15. The attachment wall elements 15 are plastic plates molded as complementary to the course of the upper edges 14, 37 of side and rear wall 12, 13 and provided on their lower edges with hooks 41 for latching onto the webs 38 of the walls 12, 13. To enable a detachable anchoring of the hooks 41, the webs 38 are, as shown in a side view of a rear upper corner of the drawer 9 in FIG. 8, in each case provided on part of their length with downwardly protruding ribs 42.

Figure 8:
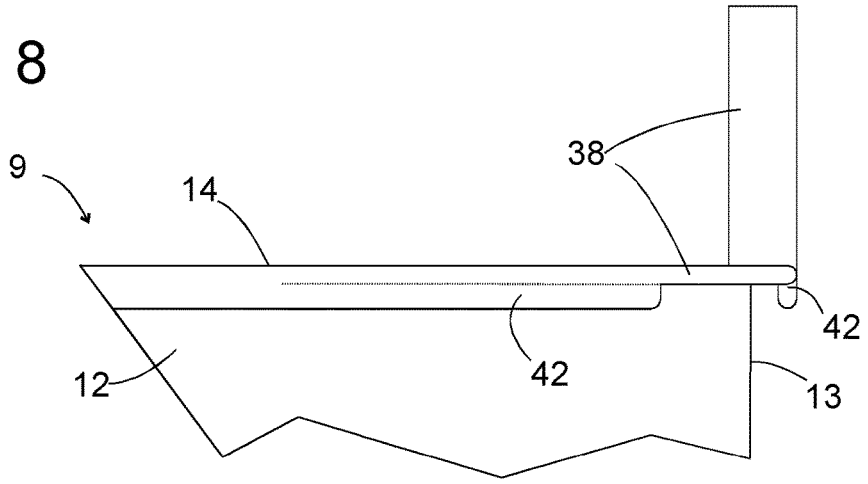
FIG. 8 shows a detail of the drawer from FIG. 7 in side view.
Figure 9:
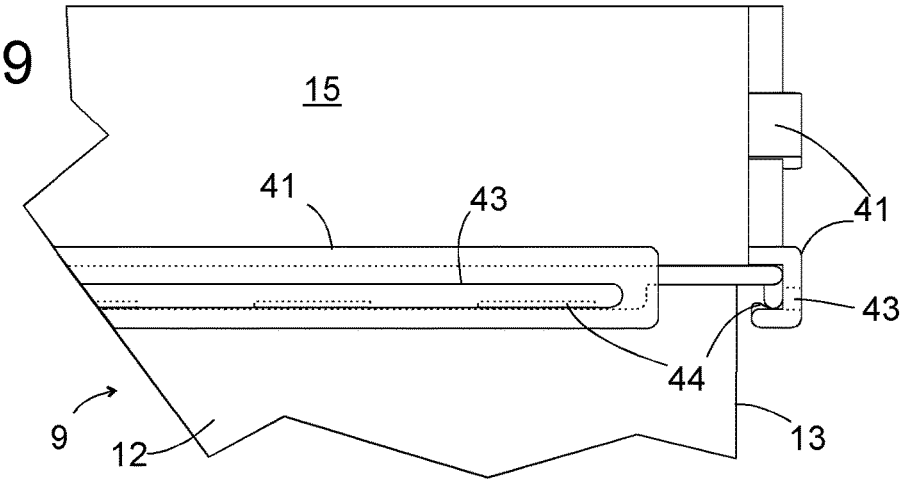
FIG. 9 shows the detail from FIG. 8 with a mounted attachment wall element.

FIG. 9 shows, in a view analogous to FIG. 8, the attachment wall element 15 mounted on the drawer 9. The hooks 41, with which the attachment wall element 15 is clamped to side and rear wall 12, 37 extend along the edges 14, 38 of the walls 12, 37 in each case over a length of a few centimeters and thanks to a longitudinal slot 43 can be elastically deformed, such that a latching lug 44 which is molded on a part of the hook 41 lying underneath the longitudinal slot 43 can be elastically deflected to be in contact with the rib 42 and, as illustrated in FIG. 9, can latch behind the rib 42, in order to fix the attachment wall element 15 in form-locking manner.

Figure 10:
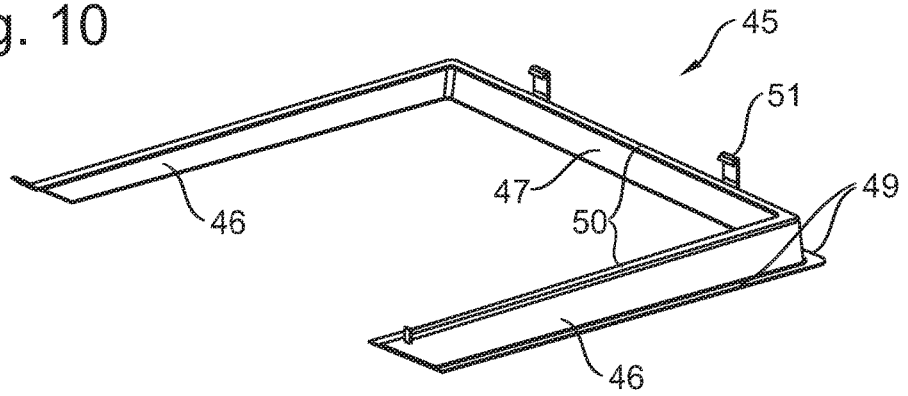
FIG. 10 shows a perspective view of a sealing frame provided for attachment to the shelf.

FIG. 10 shows in perspective view a sealing frame 45 which is provided instead of the attachment wall elements described above for sealing the intermediate space between the upper edges of side and rear wall 12, 37 and shelf 4. The sealing frame comprises two side wall elements 46, the lower edges of which are molded complementary to the course of the upper edges 14 of the side walls 12 like those of the attachment wall elements 40 in FIG. 7. The side wall elements 46 are connected to one another by a rear wall element 47. In order to create space for this rear wall element 47, the rear wall 37 of the drawer 9 of the region 48 shown in FIG. 7 projecting over the rear ends of the side walls 12 is omitted in this embodiment, and instead the upper edge of the rear wall 13 runs horizontally between the corners.

Figure 11:
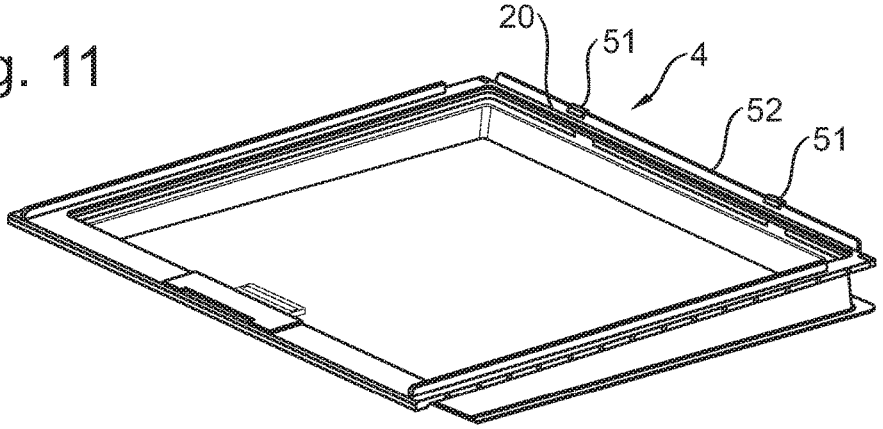
FIG. 11 shows the shelf from FIG. 2 with a suspended sealing frame.

Horizontally outward projecting flanges 49 are molded on the upper edges of the side wall and rear wall elements 46, 47, and along their upper edges flanges 50 project horizontally inward. Hooks 51 project along the upper edge of the rear wall element 47, which, as shown in FIG. 11, are provided to encompass a rib 52 projecting on the rear profile 20 of the shelf 4 and hence to anchor the sealing frame 45 in a suspended manner on the shelf 4.

Figure 12:
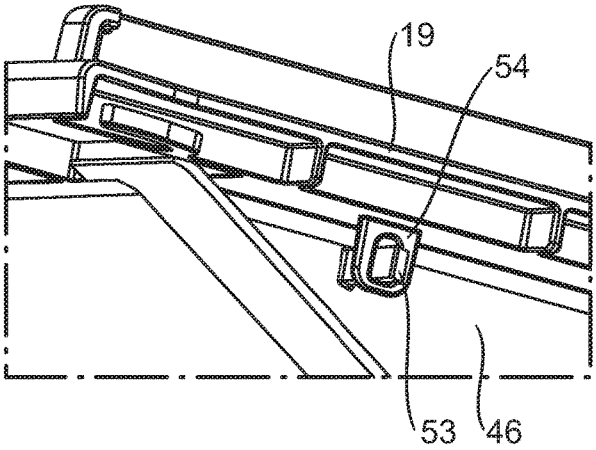
FIG. 12 shows a detail of a side wall element of the sealing frame in perspective view.

Adjacent their front ends the side wall elements 46 in each case have a pin 53 shown in FIG. 12 in an enlarged view which engages with play into a tab 54 projecting downward from its side profile 19.

Figure 13:
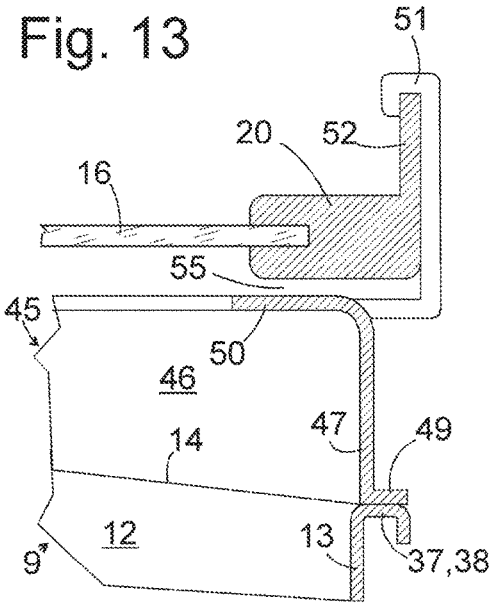
FIG. 13 shows a section through a rear wall element of the sealing frame in a position sealing the drawer.

As is apparent from the sectional illustration in FIG. 13, the engagement of the hooks 51 on the rib 52 of the shelf 4 also has slight play in the vertical direction, such that if, when the drawer 9 is pushed in, the upper edges 14 of the side walls 12 hit against the flange 49 of the sealing frame 45 prior to reaching the stop position, the sealing frame 45 can divert upward. In order to prevent this type of swerving movement, a gap 55 between the sealing frame 45 and the shelf 4 must be open providing the sealing frame 45 hangs free and without contact with the drawer 9 on the shelf 4, said shelf 4, if the drawer 9 is located in the stop position, normally narrowing as a result of lifting the sealing frame 45, but not being completely closed. Thanks to the flange 50 on the top of the sealing frame 45 the path which air must traverse in this gap 55 in order to be exchanged between the interior of the drawer 9 and the surroundings thereof must be considerably lengthened and accordingly the exchange of air is so greatly restricted by the gap 55 that the climate in the drawer 9 can be controlled by the position of the slide 22.

The following is a summary list of reference numerals and the corresponding structure used in the above description of the invention:

REFERENCE CHARACTERS

1 Body
2 Door
3 Storage area
4 Shelf
5 Upper compartment
6 Lower compartment
7 Evaporation chamber
8 Channel
9 Drawer
10 Gap
11 Front wall
12 Side wall
13 Rear wall
14 Upper edge
15 Attachment wall element
16 Plate
17 Frame
18 Front profile
19 Side profile
20 Rear profile
21 Passage
22 Slide
23 Upper element
24 Lower element
25 Base plate
26 Base plate
27 Spacer
28 Groove
29 Latching hook
30 Slot
31 Web
32 Web
33 Opening
34 Lip
35 Base part
36 Base plate
37 Upper edge
38 Web
39 Trench
40 Plateau
41 Hook
42 Rib
43 Longitudinal slot
44 Latching lug
45 Sealing frame
46 Side wall element

47 Rear wall element
48 Region
49 Flange
50 Flange
51 Hook
52 Rib
53 Pin
54 Tab
55 Gap

The invention claimed is:

1. A refrigeration device, comprising:

a body and a door delimiting a storage area;

a shelf subdividing said storage area into an upper compartment and a lower compartment, said shelf having a frame with a front edge and a rear profile, said rear profile having an upwardly protruding rib and said front edge having a passage with a cross-section, and said shelf having a plate partly inserted into a recess formed in said frame;

a drawer accommodated in said lower compartment, said drawer configured to be pushed into said lower compartment in a stop position, said drawer having a front wall bearing against said front edge of said shelf in said stop position, and said drawer having side walls, side wall elements suspended from said shelf and sealing said side walls of said drawer in said pushed-in stop position and a rear wall element interconnecting said side wall elements; and a closure element being movable between a position blocking said passage and a position opening said passage over at least part of said cross-section of said passage;

said side wall elements having hooks engaging above said upwardly protruding rib of said shelf and defining a gap between said rear profile of said frame and said side walls of said drawer for restricting an exchange of air between an interior of said drawer and the surroundings to permit said closure element to control a climate in said drawer.

2. The refrigeration device according to claim 1, wherein said side walls of said drawer have upper edges forming sealing surfaces bearing on said suspended side wall elements in said pushed-in stop position.

3. The refrigeration device according to claim 1, wherein said side wall elements are suspended from said shelf with vertical play.

4. The refrigeration device according to claim 3, wherein said side wall elements have a flange with an upper edge facing said shelf.

* * * * *